US007008234B1

(12) United States Patent
Brown

(10) Patent No.: US 7,008,234 B1
(45) Date of Patent: Mar. 7, 2006

(54) DATA BANK PROVIDING CONNECTIVITY AMONG MULTIPLE MASS STORAGE MEDIA DEVICES USING DAISY CHAINED UNIVERSAL BUS INTERFACE

(75) Inventor: Donald L. Brown, Holliston, MA (US)

(73) Assignee: Interactive Media Corporation, Millis, MA (US)

( * ) Notice: Subject to any disclaimer, the term of this patent is extended or adjusted under 35 U.S.C. 154(b) by 0 days.

(21) Appl. No.: 11/045,741

(22) Filed: Jan. 28, 2005

Related U.S. Application Data

(63) Continuation of application No. 10/187,254, filed on Jun. 27, 2002, now Pat. No. 6,875,023.

(51) Int. Cl.
*H01R 9/09* (2006.01)
*H01R 12/02* (2006.01)

(52) U.S. Cl. ..... 439/61; 710/74

(58) Field of Classification Search ..... 439/61, 439/79; 361/786, 788, 789, 686; 709/208; 710/36, 74, 129
See application file for complete search history.

(56) References Cited

U.S. PATENT DOCUMENTS

| | | | | |
|---|---|---|---|---|
| 5,873,738 | A * | 2/1999 | Shimada et al. | 439/61 |
| 5,994,894 | A * | 11/1999 | Fujita | 324/158.1 |
| 6,098,120 | A | 8/2000 | Yaotani | |
| 6,230,074 | B1 | 5/2001 | Shinkai | |
| 6,618,788 | B1 | 9/2003 | Jacobs | |
| 6,631,484 | B1 | 10/2003 | Born | |
| 6,721,176 | B1 | 4/2004 | Kwong et al. | |
| 6,763,402 | B1 * | 7/2004 | Talati | 710/36 |
| 6,779,052 | B1 | 8/2004 | Hatano | |
| 6,802,016 | B1 * | 10/2004 | Liu | 713/323 |
| 6,839,793 | B1 * | 1/2005 | Ragland | 710/316 |
| 6,859,854 | B1 | 2/2005 | Kwong | |
| 2001/0013079 | A1 | 8/2001 | Luke et al. | |
| 2002/0067593 | A1 * | 6/2002 | Milan | 361/686 |
| 2002/0078161 | A1 | 6/2002 | Cheng | |
| 2002/0081873 | A1 | 6/2002 | Harris et al. | |
| 2003/0139150 | A1 * | 7/2003 | Rodriguez et al. | 455/90 |
| 2003/0154340 | A1 | 8/2003 | Bolt | |
| 2003/0163628 | A1 | 8/2003 | Lin | |

OTHER PUBLICATIONS

UDMA 133 MobileRACK SuperRACK [online], ViPowER, Inc. [Retrieved on Jan. 28, 2003]. Retrieved from the Internet <http://www.vipower.com/>.

Network-Attached Storage White Paper [online], The Role of Network Attached Storage in the New Enterprise, Copyright Storage Computer Corporation 10/01, [Retrieved on Jan. 28, 2003]. Retrieved from the Internet <http://www.sun.com/storage/white-papers/nas.html>.

Ultra2 SCSI White Paper, LinFinity Microelectronics, Rev. 1.0, 5/96, <www.linfinity.com>.

(Continued)

*Primary Examiner*—Michael C. Zarroli
(74) *Attorney, Agent, or Firm*—Hamilton, Brook, Smith & Reynolds, P.C.

(57) ABSTRACT

A data storage system that houses at least two mass storage devices in an enclosure, along with all interconnect cabling electronics to permit access through a shared universal-type interface. An enclosure houses multiple mass storage devices such as disk drives. A set of bridges located within the enclosure provides connectivity from the disk interface to the universal-type bus. Bridge outputs are coupled to a universal hub also located within the enclosure to provide a single port interface to the array of disks. The arrangement thus provides for connectivity to multiple mass storage devices housing in a single enclosure with a single universal bus interface.

8 Claims, 6 Drawing Sheets

OTHER PUBLICATIONS

Question of the Day regarding connecting USB Hubs [online], [retrieved on Jan. 28, 2003]. Retrieved from the Internet <http://www.howstuffworks.com/question361.htm>.

Computers and Internet: Removable Storage Buying Guide provided by viewz.com [online], [retrieved on Feb. 21, 2003] Retrieved from Internet <http://computers.sympatico.ca/viewz/guides/storage2.html>.

Paris: VST shows new USB hard drives, FireWire RAID array, Staff Report, Sep. 20, 1999 [online], [retrieved on Feb. 21, 2003]. Retrieved from the Internet <http://maccentral.macworld.com/news/9909/20.vst.shtml>.

* cited by examiner

DATA BANK PROVIDING CONNECTIVITY AMONG MULTIPLE MASS STORAGE MEDIA DEVICES USING DAISY CHAINED UNIVERSAL BUS INTERFACE

RELATED APPLICATION(S)

This application is a continuation of U.S. application Ser. No. 10/187,254, filed Jun. 27, 2002, now U.S. Pat. No. 6,875,023. The entire teachings of the above application(s) are incorporated herein by reference.

BACKGROUND OF THE INVENTION

The history of computing architectures is one of exceptional and rapid advance. Indeed, the development of ubiquitous, flexible, low cost computing platforms is arguably one of the most important engineering feats of the last thirty years. It has also fundamentally changed the way in which many organizations operate.

Particular developments in communications technology over the last several years have produced an environment where many people require access to information in various forms stored in computing systems. Indeed, the need to efficiently store the virtual torrents of information that move in and out of today's business computing systems was not expected when the first computing systems and certainly the first low cost personal computer systems were first placed on the desk top.

Initially, computing system architectures for the desktop required only enough local storage capacity for application programs and data generated by individuals. A direct-attached architecture whereby storage devices such as Hard Disk Drives (HDDs) were directly connected to internal computing system such as the Advanced Technology (AT) bus was quite adequate for these needs. Organizations and their information technology departments later found it advantageous to adopt a client server model where centralized server processors manage access to relatively large centralized storage arrays. This architecture continues to use the direct-attached storage model. To achieve higher performance, most servers attached multiple HDDs using a high speed bus such as Small Computer System Interface (SCSI). The SCSI interface requires a host adapter circuit board to connect to a PC, but as a single SCSI adapter can manage up to eight units or "identifiers." Since the host adapter uses one of these identifiers, seven other identifiers may be used for additional hardware peripherals such as Hard Disk Drives, tape drives, CD-ROMs, scanners, and the like.

Despite the development of a higher speed SCSI-2 interface in the 1990s, the most widely used interface between a storage device and the processor is still the so-called "Integrated Device Electronics (IDE), or more properly the AT Attachment (or ATA)-type interface. ATA type disk drives have the drive controller built into them. They simply plug into a connector on a PC motherboard or to an AT interface adapter card. Such drives are thus quite easy to install and require a minimum number of cables given that the controller is located on the drive itself.

Because the proper controller is integrated with the disk drive itself, ATA/IDE drives are much easier for system manufacturers to configure. This has been perhaps a downfall of the SCSI interface which lacks a standard controller interface. In particular, each device's PC manufacturer seems to have its own idea of how the SCSI interface should work. While the physical connections themselves have been standardized, actual driver specifications used for communication among devices has not. The end result is that each bit of SCSI hardware typically requires its own host adapter, and the software drivers for that device typically are incompatible with adapters and drives made by other manufacturers. Because of these aforementioned difficulties, it can be cumbersome to configure arrays of SCSI based storage devices to work well with a variety of different computing platforms.

Certain other devices, such as the Kanguru™ family of storage products available from Interactive Media Corporation, provide a device that is a removable hard disk having an interface that permits it to be used both as an internal and external device. This device can provide some flexibility in making data available to multiple users and locations.

The evolution of demands on direct-attached storage architectures has also resulted in the development of additional storage initiatives. Thanks in large part to increasing use of the Internet, data is created, transmitted, stored and delivered in numerous places in an organization's computing environment. Businesses need to meet skyrocketing storage needs without an exponential increase in the required information technology personnel support and/or equipment costs.

Network Attached Storage (NAS) is yet another solution to the storage problem. This concept allows for shared use storage device that is connected to a computer network. An NAS device is typically a dedicated, high performance, high speed computing device that is optimized to stand alone and serve specific storage access needs. Its file systems are typically compatible with networking protocols such as Microsoft Windows™ environments, FTP, HTTP, and the like. The idea basically is to provide a file server having network protocol capability. This permits any other machine also connected to the network to access files and other information stored on the network attached drives.

However, even with network attached storage, there are performance penalties given that data to be transferred must be packaged according to network protocols. The networking devices themselves have inherent speed limitations as compared to directly attached storage architectures.

In addition, network attached disks can require Information Technology personnel to set up network protocols. It would be preferred if a simply plug and play-type universal interface could be used.

SUMMARY OF THE INVENTION

What is needed is a way to connect a large number of data storage devices without the need for using special adapters, local processors, or even network interfaces. This would permit an associated server processor, personal computer, or other computing device to serve as the access point to the data device while freeing the data device itself to provide for interconnectivity among media storage devices itself.

Such a storage system should also avoid the use of internal interfaces such as the SCSI interface that require adapters that are somewhat difficult to configure and indeed incompatible among different PC and storage peripheral venders.

The present invention is a data storage system that provides the ability to connect one or more mass storage devices such as Hard Disk Drives (HDDs), CD-ROMs, Digital Video Disks (DVD) Compact Disk/Read Write (DC/RW), or the like. Each mass storage device has a corresponding storage device interface, such as an Integrated Device Electronics/Advanced Technology Attachment (IDE/ATA) interface, serial ATA, solid state storage, filer channel, or the like.

Disk interface signaling is fed to a bridging device to convert the storage device interface signaling to a more general purpose, device independent external bus interface. Such a bridge, for example, may convert the IDE/ATA signaling to Universal Serial Bus (USB), Version 2 (USB2) interface. Other external universal buses interfaces such as the so-called Fire Wire-type bus may also be appropriate. What is important is that the bus use low cost IDE mechanisms and provide for inherent expanded connectivity among devices. This allows individual storage devices to be independently connected to a single external controller such as a bus controller in a computer system that is external to the enclosure in which the storage devices are housed.

In a preferred embodiment, connections among multiple mass storage devices located within the enclosure are made by daisy-chaining the bus interface connections. Specifically, each bridging device may itself include a pair of Universal interface ports. The interface ports on each bridging device are connected together. Thus, to connect multiple storage devices, cabling is used to connect the interface port on a bridge serving one of the storage devices to an interface port located on a bridge serving another interface device. A single, common output port is then provided for the storage array.

The USB and Fire Wire interfaces are examples of interfaces that are intended for external computer peripheral connectivity by using high speed, low cost serial-type bus connections. In one dependent aspect of the invention, these universal interfaces can further each use hubs to bring expanded connectivity among many devices while allowing individual devices to be independently addressable by an external controller.

In other dependent aspects, the storage media may be versatile, removable drives that can be used as both internal and external disks such as the Kanguru™ products previously mentioned.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF THE INVENTION

A description of preferred embodiments of the invention follows.

Figure 1:
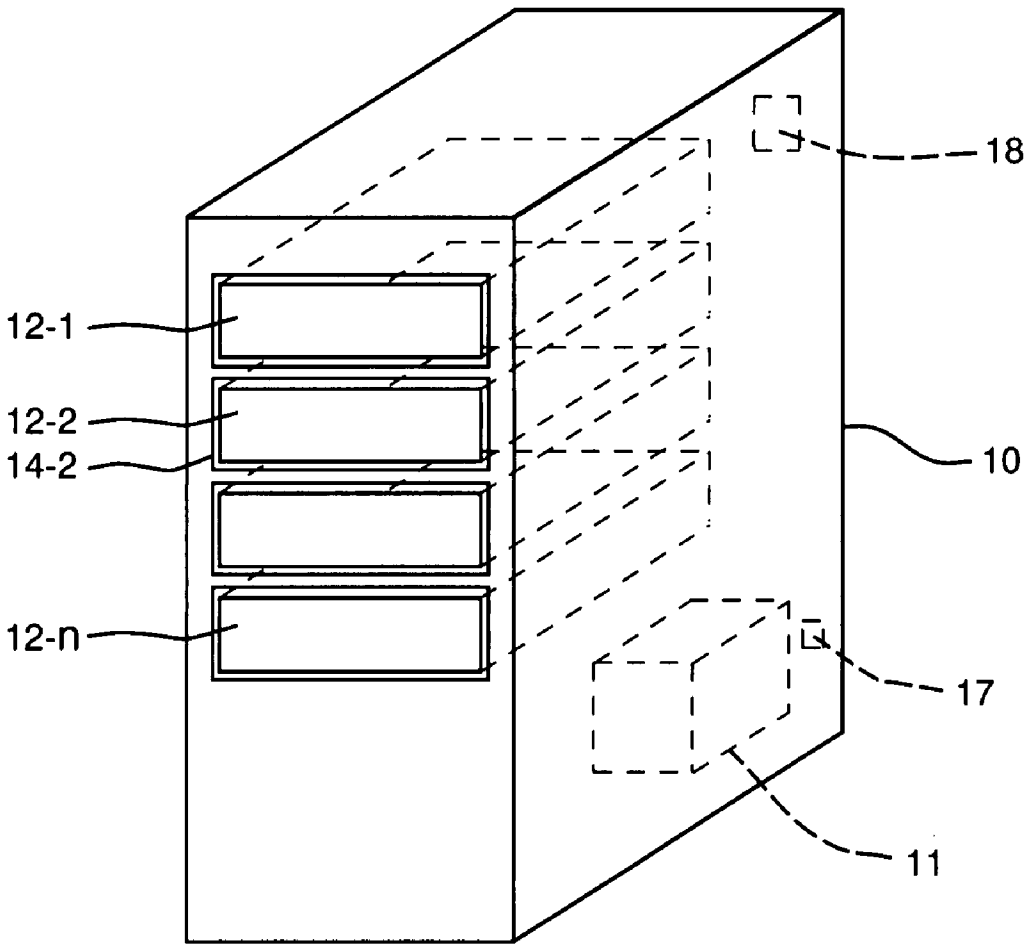
FIG. 1 is an isometric view of a storage system constructed in accordance with the invention.

FIG. 1 is an illustration of a storage unit constructed in accordance with the invention. The unit includes an enclosure 10 that houses multiple mass storage devices 12-1, 12-2, . . . , **12-*n* that fit into device brackets 14. External interfaces to the unit 10 may be quite minimal, including only, for example, a power connection 17 and single universal interface connector 18. The storage unit thus provides a low cost, convenient, storage capability that may be interfaced to a large number and variety of computing devices through the single interface 18**.

The brackets 14 each provide mechanical and electrical accommodation for use of the mass storage devices 12.

More particularly, the enclosure 10 may take the form factor of a typical tower-type personal computer enclosure. Within the enclosure 10, there is, of course, a power supply 11 that receives electrical power through the connector 17.

The individual storage devices 12 may be any convenient and/or required storage device that has, for example, a standard form factor that can fit into the tower-type enclosure 10. These, for example, may include Hard Disk Drives (HDDs), Compact Disk/Read-Only Memory (CD/ROM) drives, CD Read-Writable (CD/RW) drives, or other mass storage devices.

The drives 12 may also be a type of versatile removable drive such as the Kanguru™ products available from Interactive Media Corporation of Ashland, Mass., who is the assignee of the present invention. A Kanguru Disk™ drive provides both internal and external hard disk functionality. A Kanguru Disk™, for example, provides a mounting bracket 14 for a connection that allows a removable media package to be inserted into the housing 10. The connection provides data and power signals to the disk drive. The media can also be removed and attached through a separate interface to portable computing equipment, such as a laptop computer, as desired. When used internally, the Kanguru Disk™ offers fast data transfer speeds according to industry standards. When used externally, it can provide a portable platform for transporting essential data between locations. Although this invention would work with internal fixed storage devices, the removable Kanguru Disk™ offers additional connections, ease of use, and flexibility.

Figure 2:
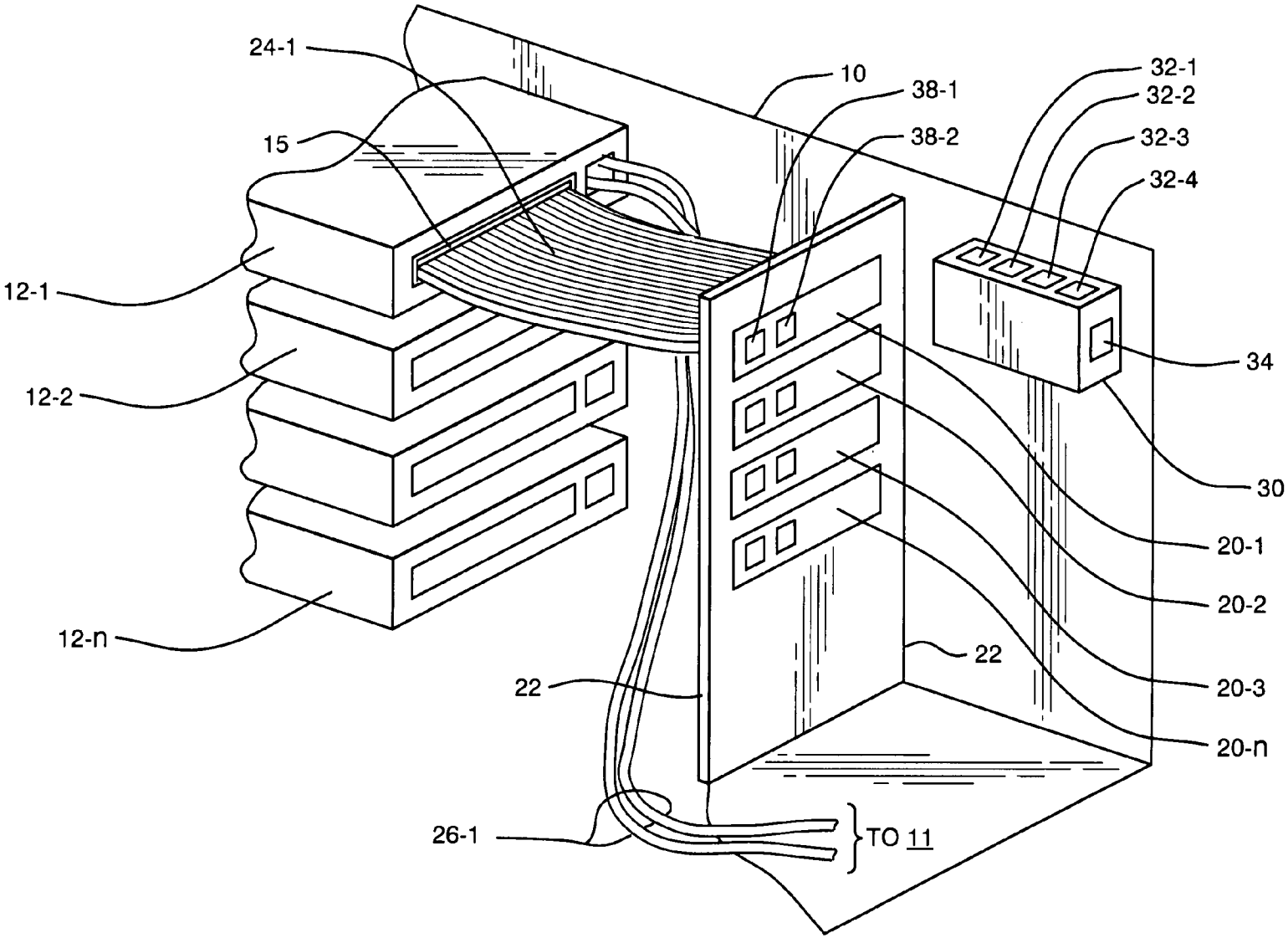
FIG. 2 is a partial internal view of the storage system showing the storage device, bridge, and internal hub connections.

FIG. 2 is a more detailed view of the invention showing the interior of the enclosure 10. An exemplary one 12-1 of the storage devices has an interface connector 15 to which are connected a pair of ribbon cables 24-1 and 26-1. The first one of the ribbon cables 24-1 provides the electrical signals that allow for external connection and control of data to and from the storage device 12-1. The ribbon cable 24-1, for example, may be configured according to the IDE/ATA-type standard interface. Other interfaces would include serial ATA or the like. Please note that although there is shown in FIG. 2 only a single storage device 12-1, it should be understood that similar ribbon cable connections are made for the other storage devices 12-2, . . . , **12-*n***.

The other ribbon cable 26-1 from each device 12 connects to the power supply 11 to provide electrical power.

The ribbon cable 24-1 containing the data signals is connected to a bridge device, or simply, bridge 20-1. There is a bridge 20-1, 20-2, . . . , **20-*n* associated with each of the storage devices 12-1, 12-2, . . . , 12-*n* placed within the enclosure 10**. It should be understood that a single bridge board could be used if it supports multiple connections.

The bridges 20 are mounted on an internal support structure 22. Bridge structure 22 may be a set of mounting rails in the case where the bridges 20 are each a single printed circuit board. It should be understood, however, that the support 22 may be itself a single printed circuit board on which are formed multiple bridge 20 circuits.

Each bridge board 20 includes a pair of interface port connectors 38-1, 38-2. Each interface port connector 38 provides an interface connection, such as a USB2 type connection to the respective bridge board 20. The bridge board not only provides conversion of the ATA/IDE type signals from the disk drive to USB2 format, but also serves as a small 2-port USB2 hub, such that the two ports 38-1 and 38-2 provide the ability to daisy-chain multiple storage units 12, so that they may be access through a single output put. This daisy-chain type interconnection of storage units will be described in greater detail below.

In accordance with one optional arrangement, a separate hub 30 may be included within the enclosure to permits interconnection of signals from the various other devices internal to the enclosure 10. The hub 30 may, for example, be a hub that provides for a number of bridged connections to be shared through the single shared output port 34. In the illustrated embodiment, there are the hub 30 is a 4-port hub having 4 ports 32-1 through 32-4.

Please note significantly that there is no electrical componentry required within the housing 10 with the exception of the bridge boards 20 and hub 30. Thus, for example, no central processing unit, disk controller interface, adapter, network card, or other devices required within the enclosure. Simply, connectivity to any of the storage devices 12 is provided through a single port to the expediency of having the enclosed hub 30 and bridge boards 20 individually allow connections to respective ones of the disks through a star-type serial interface.

Figure 3:
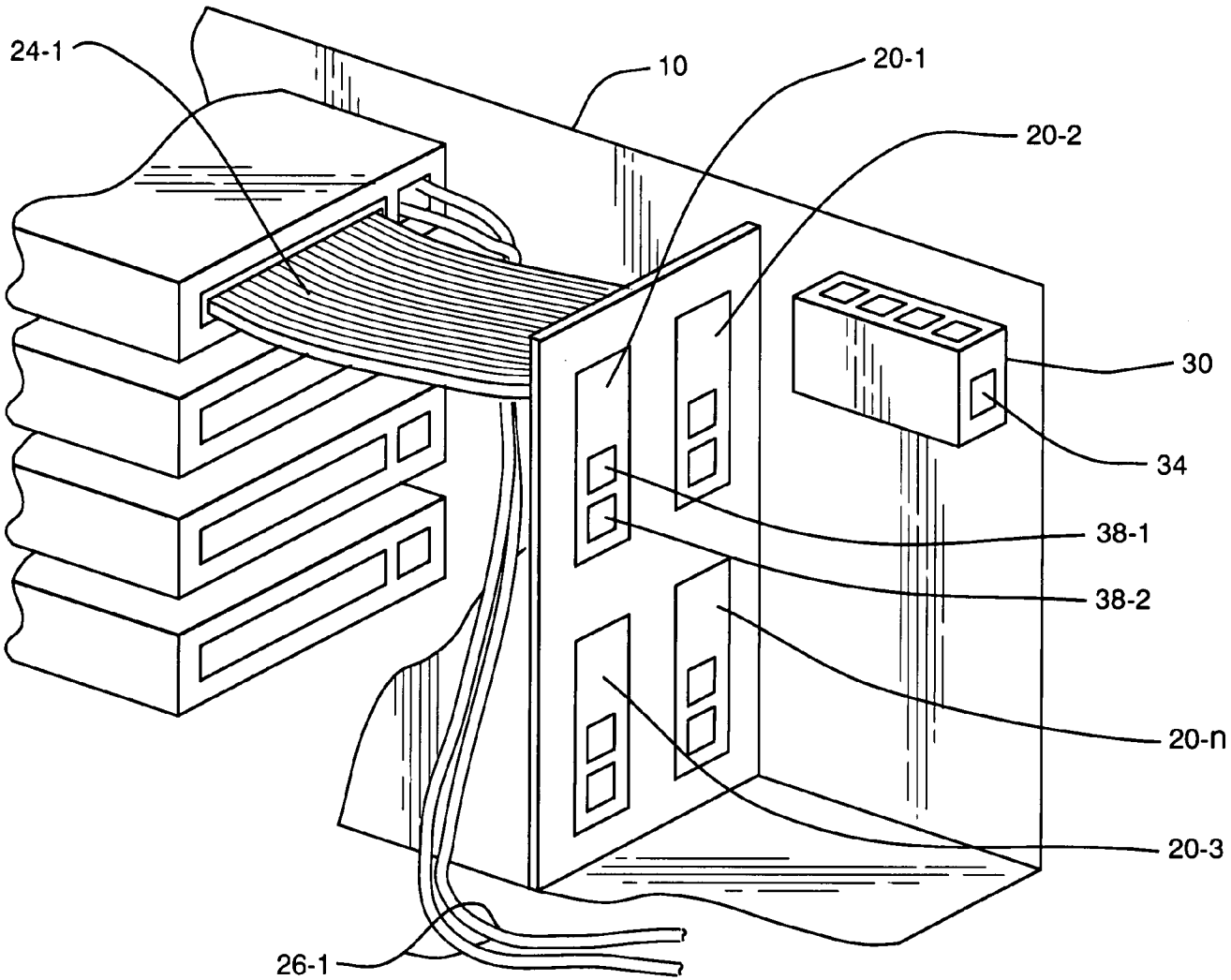
FIG. 3 is an alternative arrangement for the bridge interfaces.

FIG. 3 is another similar view showing an alternate arrangement for mounting the bridge boards 20. In this particular embodiment, the bridge boards are oriented in a relative vertical orientation. It should be understood that these may be mounted again in a similar fashion, in this case, the circuit board 23 being the preferred means of such support.

Figure 4:
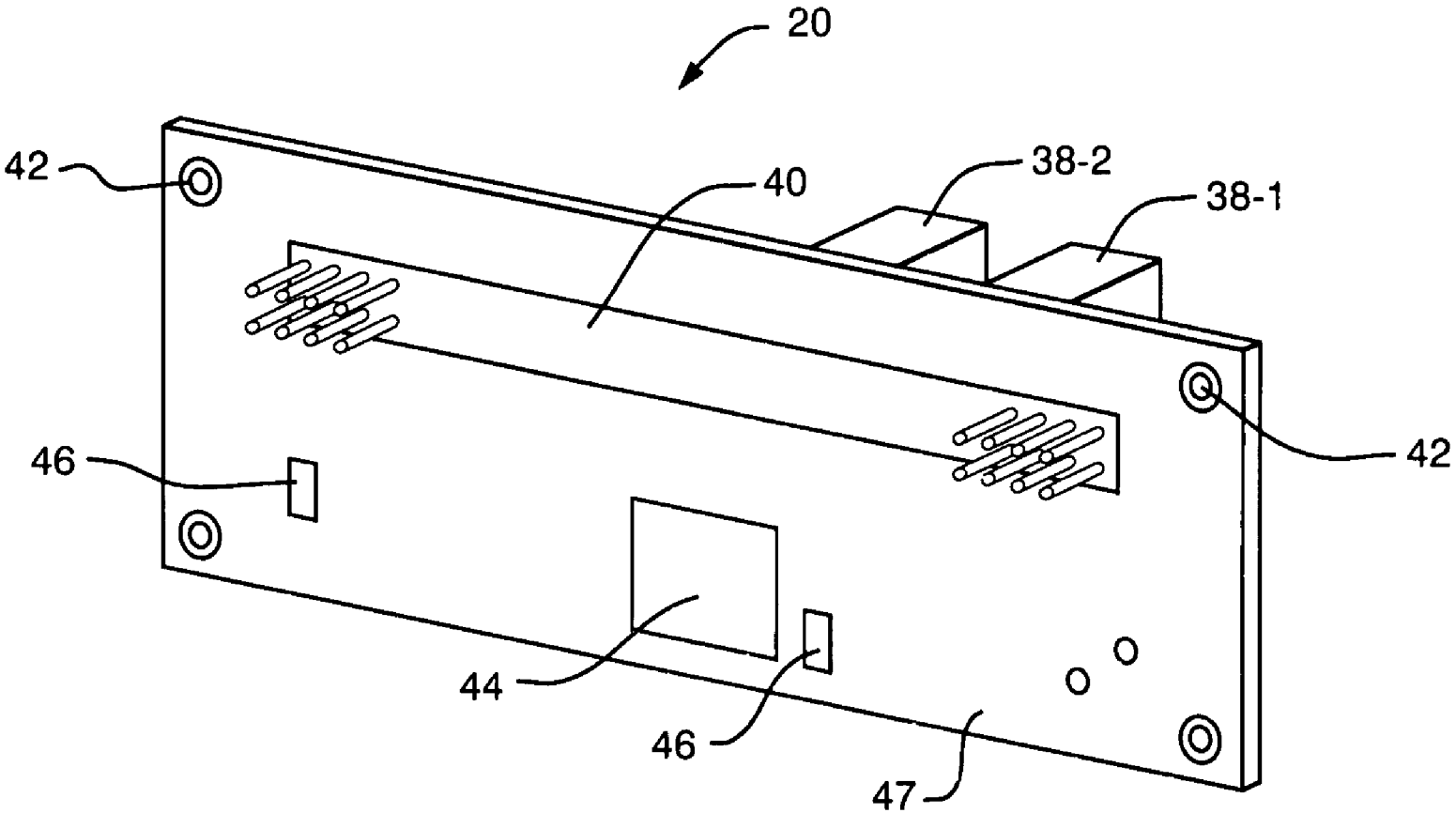
FIG. 4 is a more detailed view of a bridge.

FIG. 4 is a more detailed view of one of the bridge boards 20. Bridge board 20 contains a ribbon cable connector 40, mounting holes 42, electrical components 44 and 46 are mounted on a printed circuit board 47. Also mounted to the bridge board 20, in this case on the side of the board opposite from the ribbon cable connector 40, is an interface connector 38.

In the illustrated preferred embodiment, the bridge board 20 is a IDE to Universal Serial Bus Version 2 (USB2)-type bridge board providing interconnectivity between the USB2-type signals provided on each of the connectors 38-1 and 38-2 to IDE-type signals provided on the ribbon cable connector 40. This connectivity is provided through an integrated circuit 44 and associated electrical components 46 mounted on the PCB 47. Other circuits on the board operate as a hub, to provide for the interconnection of external USB2 devices to either port 38-1 or 38-2.

Mounting holes 42 permit mechanical mounting of the bridge board 20 to support structure 22 or 23 as in FIG. 2 or FIG. 3 respectively.

Also note that in the case of either the FIG. 2 or FIG. 3 arrangement, the support structure 22 or 23 generally disposed in an orientation which is facing the back end of the bank of storage devices 12, in a general vertical orientation within the enclosure 10. This permits the ribbon cables 24 to be exactly interconnected between the connectors 15 and 40.

Figure 5:
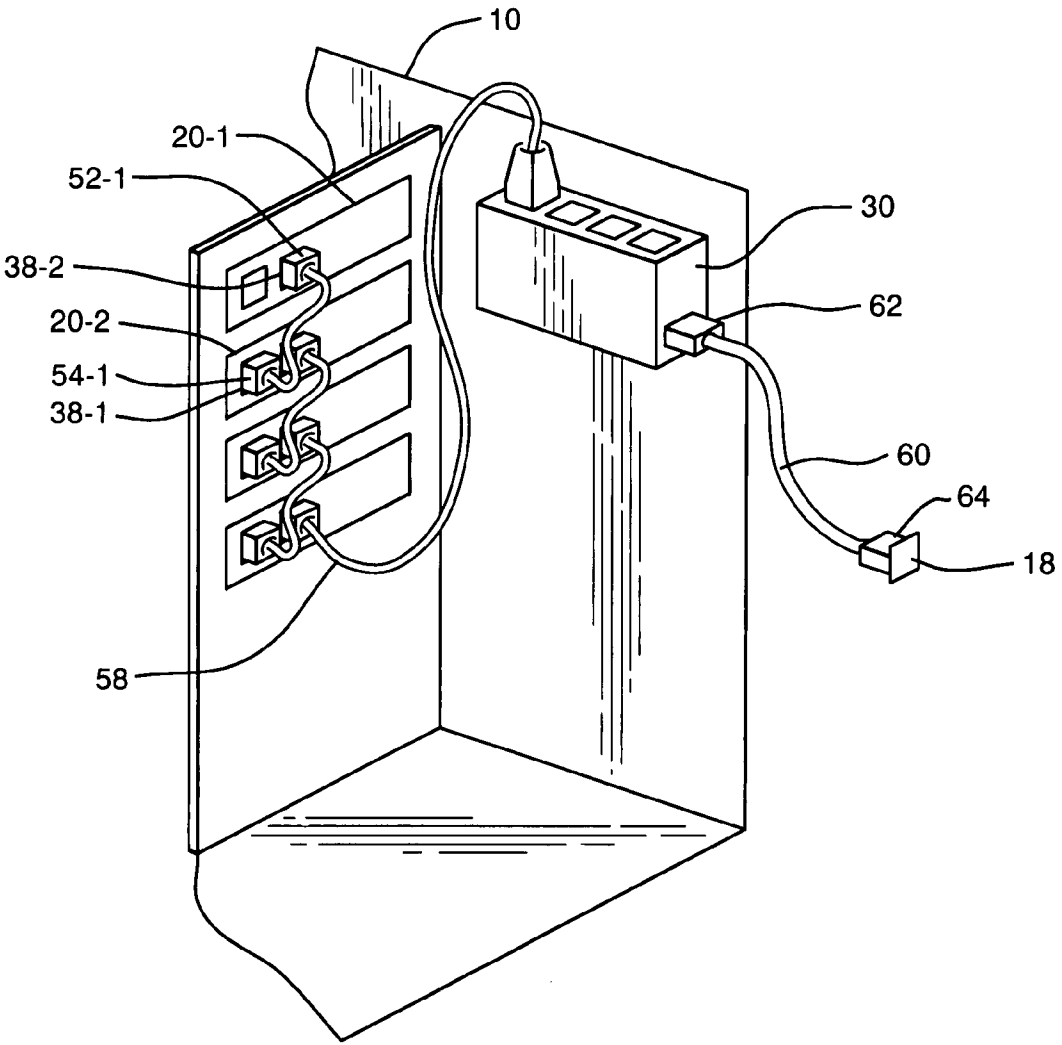
FIG. 5 is a close up view of the connection between bridges.

FIG. 5 is another view of the support structure 23 for the bridge boards 20 showing the daisy chain interconnection in more detail. In particular, an exemplary one of the bridge boards 20-1 provides signal connections through one of its USB receptacles 38-2 a receptacle 38-1 located on an adjacent bridge board 20-2, via a USB cable 50-1 containing USB plugs 52-1 and 54-1 on respective ends thereof. Specifically, a first plug 52-1 of the cable 50-1 is inserted into port 38-2 of the first bridge board 20-1, and the second plug 54-1 is inserted into a port 38-1 of the second bridge board 20-2. Additional cables 50-2 and **50-*n* are then used to interconnect the other ports 38-1 and 38-2** in this daisy chain arrangement.

The ports 38-1, 38-2 are connected as thru-ports by circuits on the bridge board. Techniques are known for this connection, such as for Fire Wire Interfaces, similar circuit techniques can be used to provide USB2 thru ports. Alternately, the bridge board can act as a small two port hub.

A final cable 58 provides access to all of the daisy chained storage units through a single USB2 connection. Although not shown in FIG. 5, this final cable 60 may be connected to an output port 18 on the enclosure.

Alternatively, the final cable 58 may be connected to a port on a hub unit 30. In this embodiment, an additional cable 60 with plug ends 62 and 64 provides connectivity from the shared port 34 output of the hub 30 to the external connection 18. Thus, through a single connection 18 by the expediency of the hub 30, cable 60 50 and bridge boards 20 many of the individual storage units 12 and any other USB3 devices located in the enclosure can be individually addressed.

Figure 6:
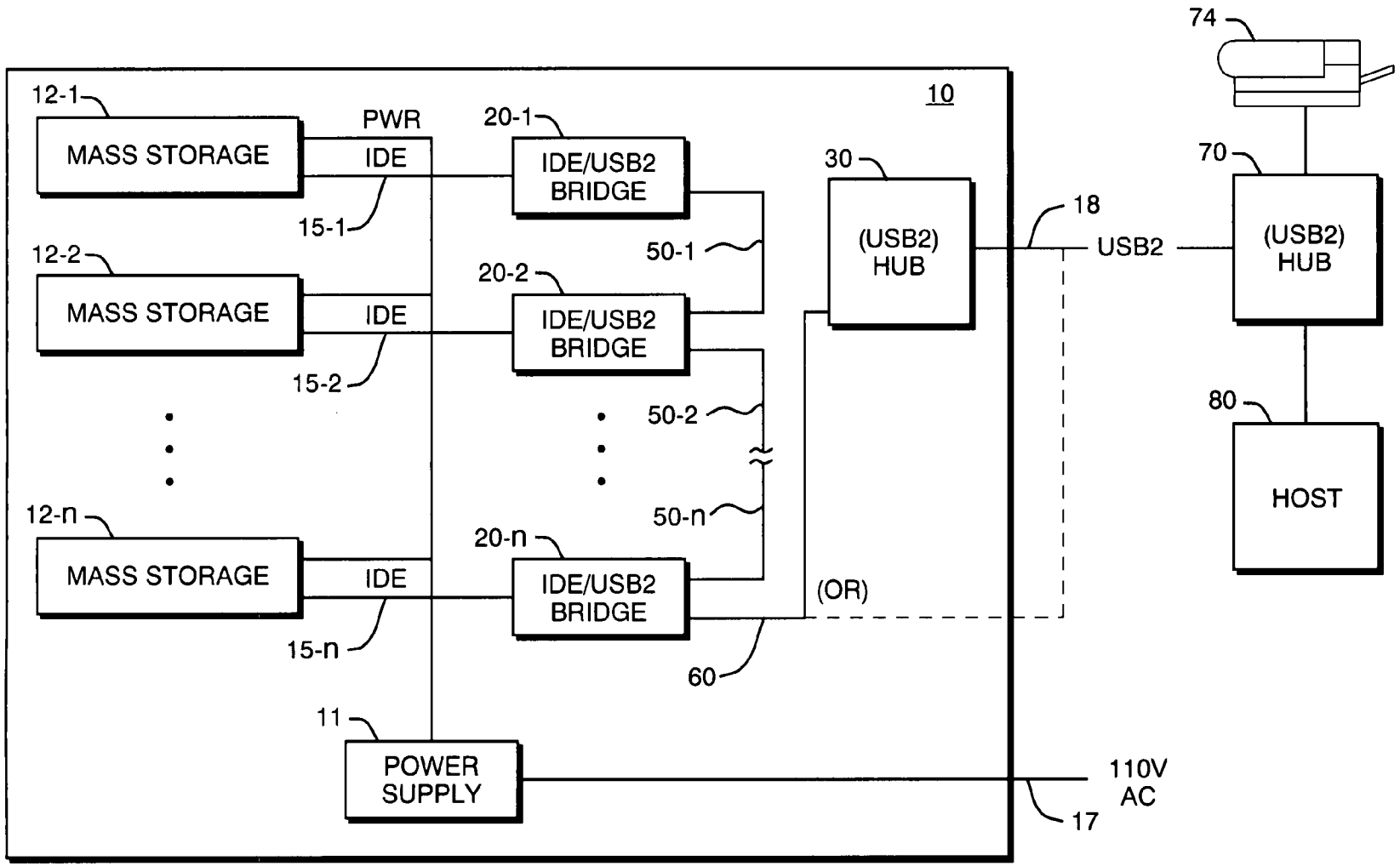
FIG. 6 is an electrical block diagram of the storage system.

FIG. 6 is an electrical block diagram of the storage system. The enclosure 10 has encased within it the mass storage devices 12-1, 12-2, . . . , **12-*n*, each communicating signals through respective IDE interfaces 15-1, 15-2, . . . , 15-*n*. Power connections are also provided to the power supply for each of the mass storage devices 12. The IDE signals 15 are fed to respective ones of the IDE/USB2 bridges 20-1, 20-2, . . . , 20-*n*, which in turn are connected in a daisy chain arrangement with the internal USB cables 50-1, 50-2, . . . , 50-*n*. Finally, the output cable 60 provides connectivity to all of the storage units 12 through the single plug 18** as a USB2 addressable unit.

Alternatively, an internal hub 30 may receive the final cable 60, so that other devices located in the enclosure 10 may also be accessed through the single interface port 18.

Thus, the entire array of mass storage devices 12 appears as a single USB unit which then itself can be connected to other USB2 hubs 70 that may be external to the enclosure 10. This allows the host 80 to provide connectivity to printers 74 and other peripheral devices, as well as the storage unit 10, all controlled via the single UBS connection.

It should be understood that while what is shown in an arrangement where discrete USB2 port sockets and cables having plug ends are used to daisy chain the bridge board, that in other embodiments, the USB2 signals could be carried on a printed circuit board 22 which comprises the bridge boards 20.

While this invention has been particularly shown and described with references to preferred embodiments thereof, it will be understood by those skilled in the art that various changes in form and details may be made therein without departing from the scope of the invention encompassed by the appended claims.

What is claimed is:

1. A data storage system comprising:

an enclosure;

an accommodation for locating a plurality of mass storage devices within the enclosure, the mass storage devices each having a corresponding device interface, and the mass storage devices each further using portable media packages that are individually insertable and removable from the accomodation;

at least one bridge device also located within the same enclosure, the bridge device arranged to receive signaling from at least one of the device interfaces, the bridge device converting the storage device interface signaling to universal bus signaling, each bridge device also providing one or more universal bus port connections to permit access to at least one of the mass storage devices;

a hub unit, also located within the same enclosure as the bridge device, the hub having a plurality of universal serial bus ports to be accessed through a shared port and interconnecting a universal serial bus port associated with at least one of the storage devices to a universal serial bus port on the hub unit; and such that one of the remaining universal serial bus port connections is used as a common interface to access at least a first and second storage device of the plurality of mass storage devices.

2. An apparatus as in claim 1 wherein multiple bridge devices are each located on a support structure that has a generally facing relationship with the rear portion of the storage devices to permit interconnection of cables between the storage device interfaces and the bridges.

3. An apparatus as in claim 2 wherein the storage device accommodations are generally located in approximately stacked vertical orientation with respect to one another.

4. An apparatus as in claim 1 wherein the hub unit is connected to a plurality of bridge devices to provide access to other mass storage devices located within the same enclosure through the shared port.

5. An apparatus as in claim 4 wherein the hub unit is a module located adjacent the bridge devices or integrated therewith.

6. An apparatus as in claim 1 wherein the device interfaces are an Integrated Device Electronics (IDE)/Advanced Technology Attachment (ATA)-type interface.

7. An apparatus as in claim 1 wherein the universal bus is a Universal Serial Bus-type 2 interface.

8. An apparatus as in claim 1 wherein the universal bus is a Fire Wire bus.

* * * * *